US007673465B2

(12) United States Patent
Choi et al.

(10) Patent No.: US 7,673,465 B2
(45) Date of Patent: Mar. 9, 2010

(54) AIR-CONDITIONING SYSTEM AND APPARATUS FOR PROTECTING THE SAME

(75) Inventors: Jae Heuk Choi, Seoul (KR); Yoon Been Lee, Seoul (KR); Baik Young Chung, Incheon (KR); Se Dong Chang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 1072 days.

(21) Appl. No.: 11/263,992

(22) Filed: Nov. 2, 2005

(65) Prior Publication Data

US 2006/0090495 A1 May 4, 2006

(30) Foreign Application Priority Data

Nov. 3, 2004 (KR) ..... 10-2004-0088951

(51) Int. Cl.
*F25B 5/02* (2006.01)

(52) U.S. Cl. ..... 62/200; 251/129.15

(58) Field of Classification Search ..... 62/217, 62/200, 203; 251/64, 129.15, 129.01
See application file for complete search history.

(56) References Cited

U.S. PATENT DOCUMENTS 921,760 A * 5/1909 Waterman ..... 137/554
2,061,599 A * 11/1936 Smith ..... 62/117
4,720,982 A 1/1988 Shimizu et al.
5,131,237 A 7/1992 Valbjorn

FOREIGN PATENT DOCUMENTS

| | | |
|---|---|---|
| EP | 0 410 570 A2 | 1/1991 |
| EP | 1 481 827 A1 | 12/2004 |
| GB | 917619 A | 2/1963 |
| JP | 11-23038 A | 1/1999 |
| KR | 1999-0024894 | 7/1999 |
| KR | 20-2002-288626 | 9/2002 |

* cited by examiner

*Primary Examiner*—William E Tapolcai
(74) *Attorney, Agent, or Firm*—Birch, Stewart, Kolasch & Birch, LLP

(57) ABSTRACT

An air conditioning system and an apparatus for protecting the same. The air conditioning system comprise an outdoor unit, a plurality of indoor units connected to the outdoor unit by each refrigerant line, and a refrigerant line closing unit installed at the refrigerant line of the indoor unit for preventing a refrigerant flowing on the refrigerant line of the indoor unit from being introduced into the outdoor unit when power supply to one or more indoor units is cut off.

12 Claims, 6 Drawing Sheets

AIR-CONDITIONING SYSTEM AND APPARATUS FOR PROTECTING THE SAME

BACKGROUND OF THE INVENTION

1. Field of the Invention

The present invention relates to an air conditioning system and an apparatus for protecting the same, and more particularly, to an air conditioning system capable of preventing a liquid refrigerant of a high pressure and a high temperature from being introduced into an outdoor unit under a state an expansion valve of an indoor unit is opened when power supply to the indoor unit is cut off due to a static electricity or a short circuit, etc., and an apparatus for protecting the same.

2. Description of the Background Art

Generally, an air conditioning system serves to control a temperature, a humidity, a stream, and a cleanliness degree of air for a comfortable indoor environment. The air conditioning system is classified into an integral type constructed as an indoor unit and an outdoor unit are installed in a single case, and a separated type constructed as a compressor and a condenser are installed at an outdoor unit and an evaporator is installed in an indoor unit.

Recently, a multi-type air conditioning system having a plurality of indoor units for cooling or heating each space of an indoor room is increasing.

FIG. 1 is a construction view showing a multi-type air conditioning system in accordance with the conventional art.

As shown, the conventional multi-type air conditioning system 1 comprises a plurality of indoor units 10, and an outdoor unit 20 connected to each indoor unit 10 for compressing a refrigerant.

Each of the indoor units 10 is disposed at an indoor room. The indoor unit 10 is composed of an indoor heat exchanger 11 for heat-exchanging a refrigerant, and an indoor expansion valve 13 connected to the indoor heat exchanger 11 for depressurizing and expanding a refrigerant.

The outdoor unit 20 includes a plurality of compressors 23 for compressing a refrigerant, an accumulator 35 connected to an inlet refrigerant line of the compressor 23 for providing a gaseous refrigerant of a low temperature and a low pressure to the compressor 23, and a plurality of outdoor heat exchangers 41 connected to the compressor 23 for heat-exchanging a refrigerant.

An oil balancing pipe 25 is connected between each of the compressors 23, and an oil separator 27 for separating a refrigerant from oil is installed at an is outlet refrigerant line of each compressor 23. An oil returning line 28 for returning oil separated from a refrigerant to the compressor 23 is installed at the oil separator 27, and a check valve 29 is installed at an outlet refrigerant line of the oil separator 27.

A four-way valve 31 for switching a refrigerant flow is installed at an outlet refrigerant line of the check valve 29. Three ports 31*a* of the four-way valve 31 are respectively connected to an outdoor heat exchanger 41, an accumulator 35, and an indoor unit 10 by each refrigerant line.

A check valve 43 and an outdoor expansion valve 45 are installed at an outlet refrigerant line of each outdoor heat exchanger 41 along a flow direction of a refrigerant at the time of a cooling operation. Also, a service valve 37 is installed at an outlet refrigerant line of the check valve 43 and a refrigerant line of the indoor unit 10.

However, the conventional multi-type air conditioning system has following problems. When power supply to the indoor unit is cut off due to a static electricity or a short circuit, a liquid refrigerant of a high temperature and a high pressure introduced into the indoor unit 10 from the outdoor unit 20 is introduced into the outdoor unit 20 as an abnormal state that the liquid refrigerant is not heat-exchanged by the corresponding heat exchanger 11 under a state that the indoor expansion valve 13 is opened. As the result, not only the compressor 23 but also the entire air conditioning system may be damaged.

BRIEF DESCRIPTION OF THE INVENTION

Therefore, an object of the present invention is to provide an air conditioning system capable of preventing a compressor and an entire system from being damaged by preventing a liquid refrigerant of a high pressure and a high temperature introduced into an indoor unit from an outdoor unit from being introduced into the outdoor unit when power supply to the indoor unit is cut off due to a static electricity or a short circuit, etc., and an apparatus for protecting the same.

To achieve these and other advantages and in accordance with the purpose of the present invention, as embodied and broadly described herein, there is provided an air conditioning system, comprising: an outdoor unit having a compressor and an outdoor heat exchanger; at least one indoor unit having an indoor expansion valve and an indoor heat exchanger; and a refrigerant line closing unit installed at a refrigerant line of the indoor unit for preventing a refrigerant flowing on the refrigerant line of the indoor unit from being introduced into the outdoor unit when power supply to one or more indoor units is cut off.

The refrigerant line closing unit can be arranged at an inlet refrigerant line of each indoor unit or at an outlet refrigerant line of each indoor unit. Also, the refrigerant line closing unit can be arranged at a refrigerant line between the indoor expansion valve and the indoor heat exchanger, and can be arranged at both the inlet refrigerant line and the outlet refrigerant line of the indoor unit.

To achieve these and other advantages and in accordance with the purpose of the present invention, as embodied and broadly described herein, there is also provided an apparatus for protecting an air conditioning system, comprising: a housing installed at a refrigerant line; a bobbin installed in the housing and having a coil wound on an outer circumferential surface thereof; a rod member movably installed at a center of the bobbin and having a valve at one side thereof for selectively closing the refrigerant line by a magnetization of the bobbin; and an elastic member inserted into the rod member.

A space in which the rod member moves is formed in the middle of the bobbin, and a motion distance of the valve of the rod member is limited by a stopper installed in the housing.

When power is supplied to the indoor unit, the valve of the rod member opens the refrigerant line of the indoor unit. On the contrary, when power supply to the indoor unit is cut off, the valve of the rod member closes the refrigerant line of the indoor unit.

Preferably, a mounting groove for mounting an end surface of the valve of the rod member when the refrigerant line is closed is formed at a bottom surface of the refrigerant line of the indoor unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, preferred embodiments of an air conditioning system and an apparatus for protecting the same will be explained with reference to attached drawings.

Figure 1:
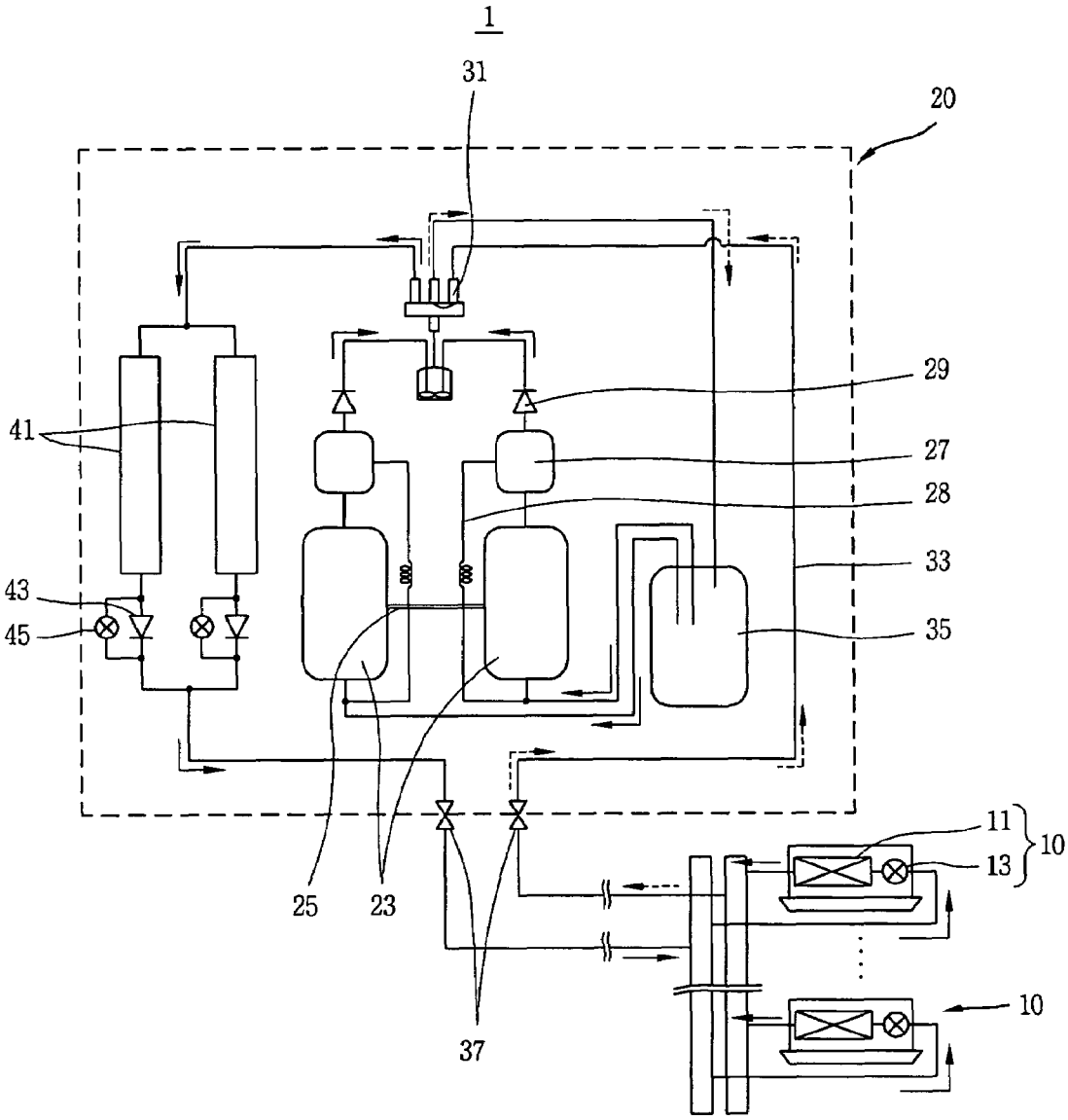
FIG. 1 CONVENTIONAL ART
FIG. 1 is a construction view showing a multi-type air conditioning system in accordance with the conventional art.
Figure 2:
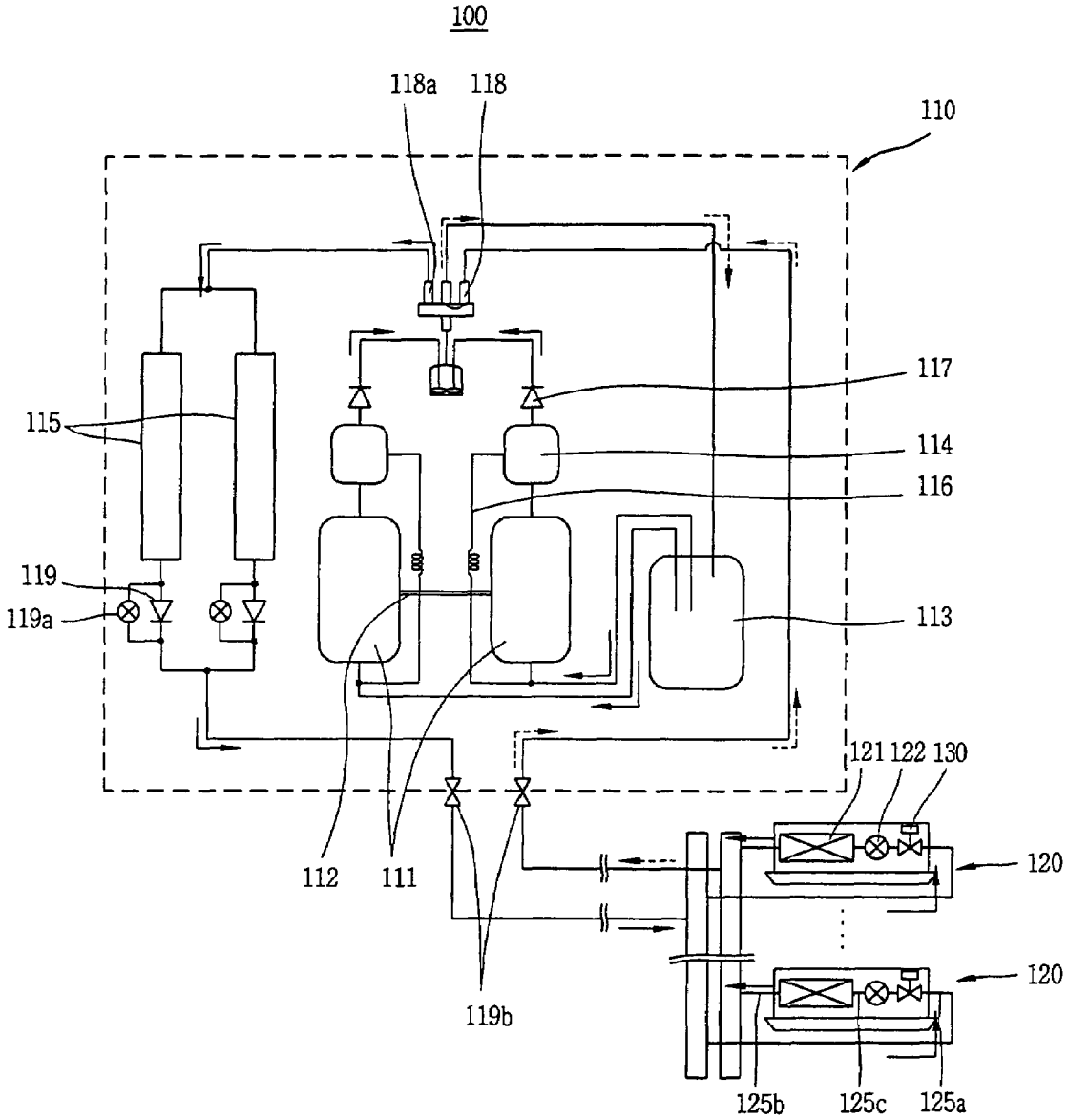
FIG. 2 is a construction view showing an air conditioning system according to a first embodiment of the present invention.
Figure 3:
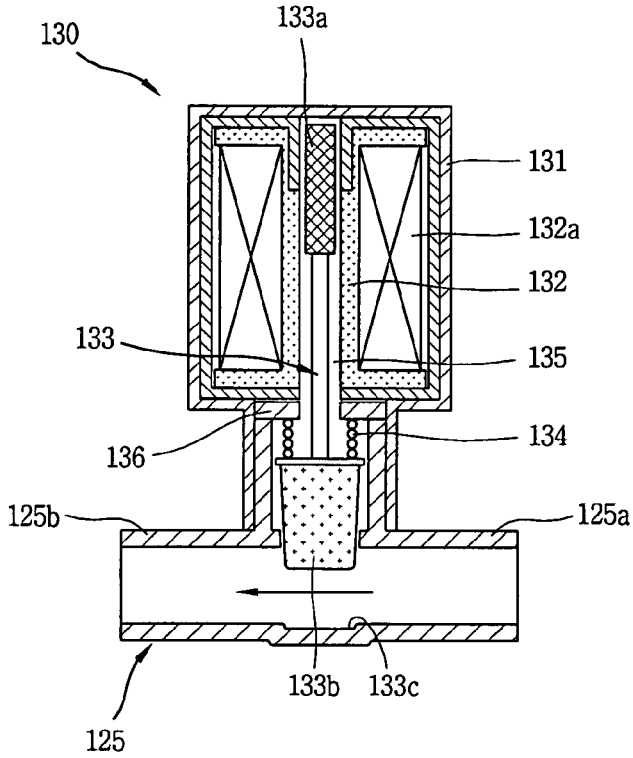
FIG. 3 is a longitudinal section view showing an apparatus for protecting the air conditioning system according to a first embodiment of the present invention, which shows an opened state of a refrigerant line of a valve.
Figure 4:
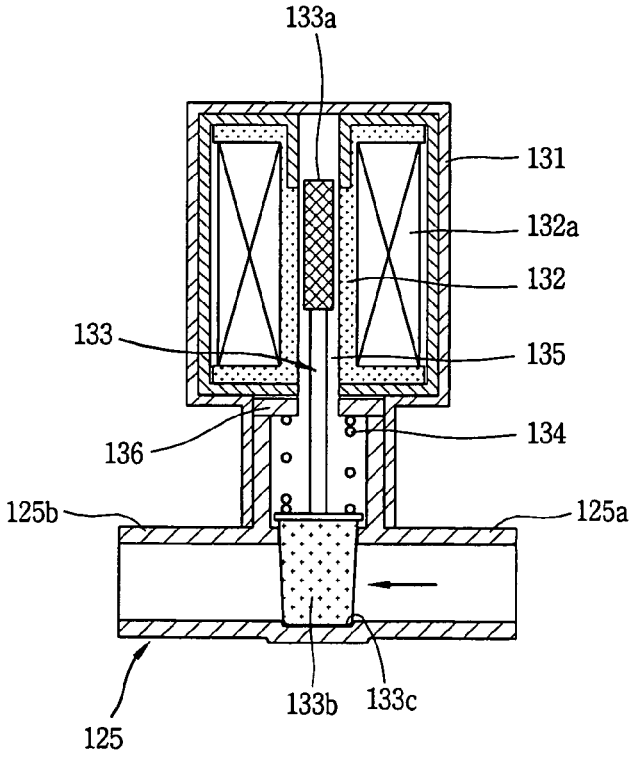
FIG. 4 is a longitudinal section view showing the apparatus for protecting the air conditioning system according to a first embodiment of the present invention, which shows a closed state of the refrigerant line of the valve.

FIG. 2 is a construction view showing an air conditioning system according to a first embodiment of the present invention, FIG. 3 is a longitudinal section view showing an apparatus for protecting the air conditioning system according to a first embodiment of the present invention, which shows an opened state of a refrigerant line of a valve, and FIG. 4 is a longitudinal section view showing the apparatus for protecting the air conditioning system according to a first embodiment of the present invention, which shows a closed state of the refrigerant line of the valve.

As shown, an air conditioning system 100 according to a first embodiment of the present invention comprises an outdoor unit 110 having a compressor 111 and an outdoor heat exchanger 115, at least one indoor unit 120 having an indoor expansion valve 122 and an indoor heat exchanger 121, and a refrigerant line closing unit 130 installed at an inlet refrigerant line 125*a* of each indoor unit 120 for preventing a refrigerant flowing on a refrigerant line 125 of the indoor unit 120 from being introduced into the outdoor unit 110 when power supply to one or more indoor units 120 is cut off.

The refrigerant line 125 of the indoor unit 120 comprises an inlet refrigerant line 125*a*, an outlet refrigerant line 125*b*, and a refrigerant line 125*c* between the indoor expansion valve 122 and the indoor heat exchanger 121.

The inlet refrigerant line 125*a* of the indoor unit 120 denotes a refrigerant line for introducing a refrigerant into the indoor unit 120 from the outdoor unit 110 according to a flow direction of a refrigerant, and the outlet refrigerant line 125*b* of the indoor unit 120 denotes a refrigerant line for passing a refrigerant from the indoor unit 120 to the outdoor unit 110.

The outdoor unit 110 comprises a plurality of compressors 111 for compressing a refrigerant, an accumulator 113 connected to the inlet refrigerant line 125*a* for providing a gaseous refrigerant to the compressor 111, and a plurality of outdoor heat exchangers 115 connected to the compressors 111 for heat-exchanging a refrigerant.

An oil balancing pipe 112 is connected between each of the compressors 111, and an oil separator 114 for separating a refrigerant from oil is installed at an outlet refrigerant line of each compressor 111. An oil returning line 116 for returning oil separated from a refrigerant to the compressor 111 is installed at the oil separator 114, and a check valve 117 is installed at an outlet refrigerant line of the oil separator 116.

A four-way valve 118 for switching a refrigerant flow is installed at an outlet refrigerant line of the check valve 117. Three ports 118*a* of the four-way valve 118 are respectively connected to an outdoor heat exchanger 115, an accumulator 113, and an indoor unit 120 by each refrigerant line.

A check valve 119 and an outdoor expansion valve 119*a* are installed at an outlet refrigerant line of each outdoor heat exchanger 115 along a flow direction of a refrigerant at the time of a cooling operation. Also, a service valve 119*c* is installed at an outlet refrigerant line of the check valve 119 and at the refrigerant line 125 of the indoor unit 120.

Each of the indoor units 120 is arranged at an indoor room. The indoor unit 120 is composed of an indoor heat exchanger 121 for heat-exchanging a refrigerant, and an indoor expansion valve 122 connected to the indoor heat exchanger 121 for depressurizing and expanding a refrigerant.

During a cooling operation, a refrigerant flowing on the refrigerant line of the outdoor unit is introduced into the indoor unit 120 as a liquid state of a high temperature and a high pressure. Then, the refrigerant passes through the indoor expansion valve 122 and the indoor heat exchanger 121, and is converted into a gaseous state of a low temperature and a low pressure. Then, the refrigerant is re-introduced into the outdoor unit 110.

However, if a static electricity, a short circuit, etc. occurs during the cooling operation, the indoor expansion valve 122 is opened and thus the liquid refrigerant of a high pressure and a high temperature having introduced into the indoor unit 120 is not converted into a gaseous refrigerant but is directly introduced into the outdoor unit 110. As the liquid refrigerant of a high temperature and a high pressure is introduced into the outdoor unit 110, the compressor 111 or the entire air conditioning system may be damaged. In the air conditioning system according to the first embodiment of the present invention, when power supply to the indoor unit 120 is cut off due to a static electricity, a short circuit, etc. during a cooling operation, an apparatus for protecting the air conditioning system 100, that is, the refrigerant line closing unit 130 is installed at the inlet refrigerant line 125*a* of the indoor unit 120 in order to prevent the damage of the compressor 111 and the entire air conditioning system.

The apparatus for protecting the air conditioning system according to the present invention comprises a housing 131 installed at the refrigerant line of the indoor unit, a bobbin 132 installed in the housing 131 and having a coil 132*a* wound on an outer circumferential surface thereof, a rod member 133 movably installed at a center of the bobbin 132 and having a valve 133*b* at one side thereof for selectively closing the refrigerant line of the indoor unit by a magnetization of the bobbin 132, and an elastic member 134 inserted into the rod member 133.

More specifically, as shown in FIG. 3, the housing 131 is installed to be perpendicular to the refrigerant line 125 of the indoor unit. Also, the rod member 133 is constructed to be movable in a direction perpendicular to a space 135 formed at the center of the bobbin 132. The rod member 133 is provided with a valve 133*b* for closing the refrigerant line at one side thereof. Also, the rod member 133 is provided with an iron-metal portion 133*a* or a magnetic substance portion at another side thereof so that the rod member 133 can be moved by the magnetized bobbin 132.

During a cooling operation, a current also flows on the coil 132*a* of the bobbin 132, and thereby the valve 133*b* of the rod member 133 is placed at a position for opening the refrigerant line 125 of the indoor unit by the bobbin magnetized by the current. When power supply to the indoor unit 120 is cut off, the valve 133*b* of the rod member 133 is placed at a position for closing the refrigerant line 125 of the indoor unit 120.

A motion distance of the valve 133*b* of the rod member 133 is limited by a stopper 136 installed in the housing 131. Also, a mounting groove 133*c* for mounting an end surface of the valve 133*b* of the rod member 133 when the refrigerant line 125 of the indoor unit is closed is formed at a bottom surface 126 of the refrigerant line 125 of the indoor unit. The mounting groove 133*c* prevents the valve 133*b* from moving when the refrigerant line 125 of the indoor unit is closed.

An operation of the air conditioning system according to a first embodiment of the present invention will be explained.

During a cooling operation, power is supplied to each indoor unit and current also flows on the coil 132*a* of the protecting apparatus 130 for the air conditioning system. Under the state, the magnetized bobbin 132 pulls the iron-metal portion 133*a* thereby to pull the rod member 133. By the rod member 133, the spring 134 is compressed and the valve 133*b* is placed at a position for opening the refrigerant line 125 of the indoor unit.

If power supply to each indoor unit 120 is cut off due to a static electricity or a short circuit, a current is not applied to the coil 132*a* and thereby the bobbin 132 loses its magnetization force. The rod member 133 moves by an elastic force of the compressed spring 134, and the valve 133*b* closes the refrigerant line 125 of the indoor unit. Accordingly, the liquid refrigerant of a high temperature and a high pressure flowing on the indoor unit 120 is prevented from being introduced into the outdoor unit 110 (refer to FIG. 4).

Therefore, in the present invention, a phenomenon that an abnormal refrigerant which has not obtained a sufficient degree of superheat via the indoor expansion valve 122 and the indoor heat exchanger 121 is directly introduced into the outdoor unit 110 when power supply to the indoor unit 120 is cut off due to a static electricity or a short circuit during a cooling operation is prevented. Accordingly, the compressor 112 and the entire air conditioning system are prevented from being damaged.

Figure 5:
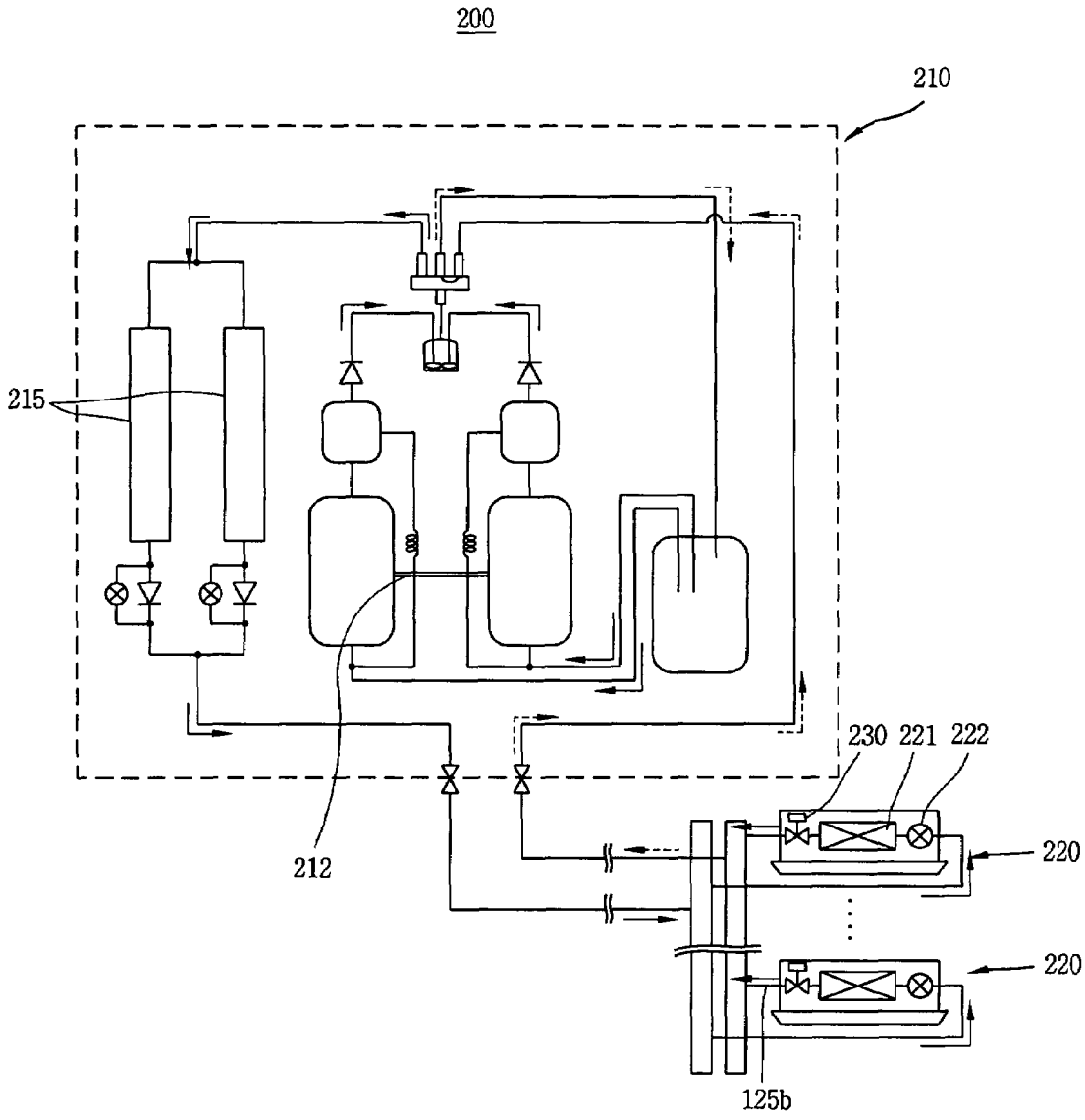
FIG. 5 is a construction view showing an air conditioning system according to a second embodiment of the present invention.

FIG. 5 is a construction view showing an air conditioning system according to a second embodiment of the present invention.

As shown, the air conditioning system 200 according to a second embodiment of the present invention comprises an outdoor unit 210 having a compressor 211 and an outdoor heat exchanger 215, at least one indoor unit 220 having an indoor expansion valve 222 and an indoor heat exchanger 221, and a refrigerant line closing unit 230 installed at an outlet refrigerant line 125*b* of each indoor unit 220 for preventing a refrigerant flowing on the refrigerant line 125 of the indoor unit 220 from being introduced into the outdoor unit 210 when power supply to one or more indoor units 220 is cut off.

In the air conditioning system 200 according to the second embodiment of the present invention, the refrigerant line closing unit 230 is installed at the outlet refrigerant line 125*b* of each of the indoor unit 220.

An operation of the air conditioning system 200 according to the second embodiment of the present invention is the same as that of the air conditioning system 100 according to the first embodiment, and thus its detail explanation will be omitted.

Figure 6:
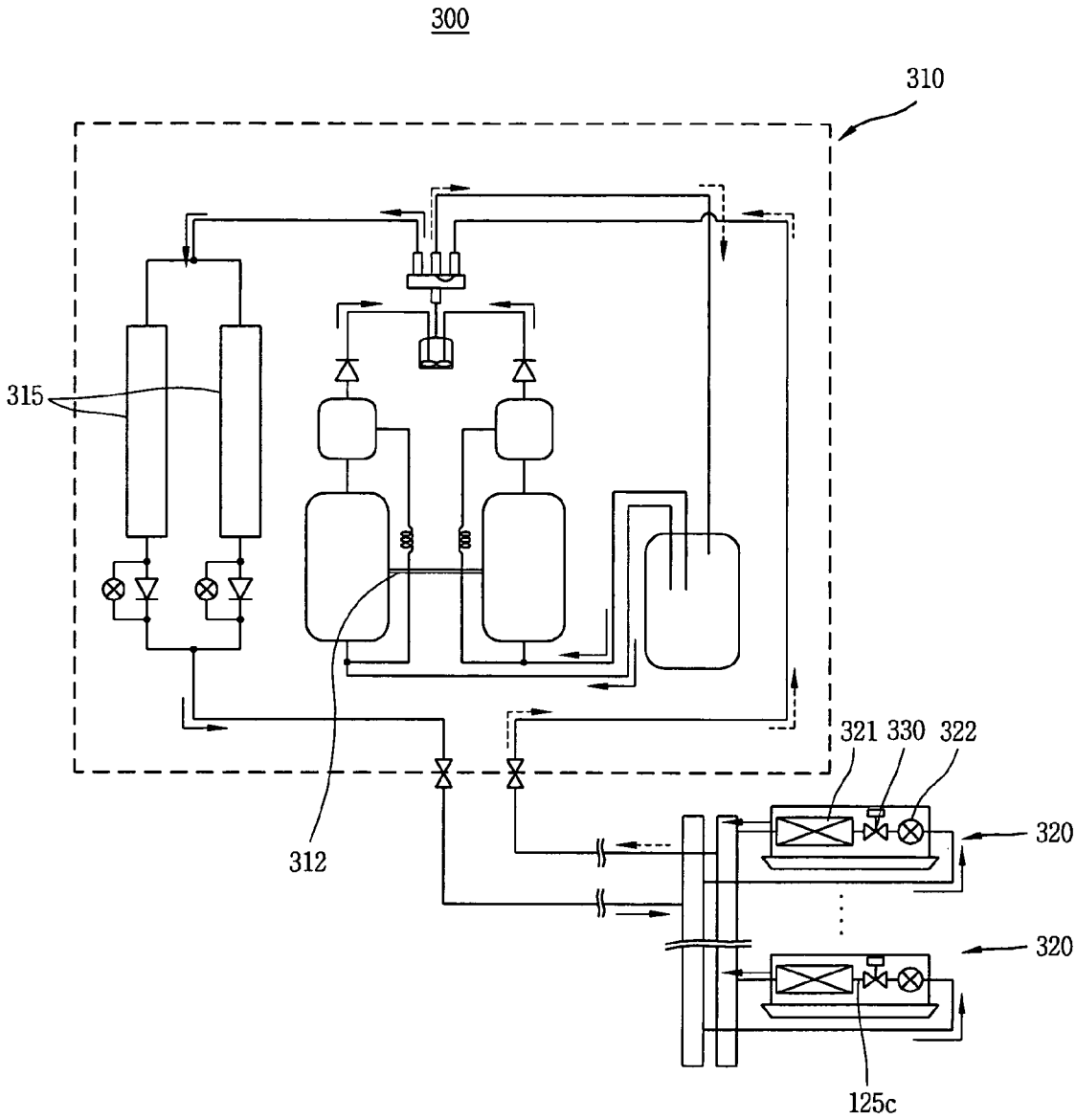
FIG. 6 is a construction view showing an air conditioning system according to a third embodiment of the present invention.

FIG. 6 is a construction view showing an air conditioning system according to a third embodiment of the present invention.

As shown, the air conditioning system 300 according to the third embodiment of the present invention comprises an outdoor unit 310 having a compressor 311 and an outdoor heat exchanger 315, at least one indoor unit 320 having an indoor expansion valve 322 and an indoor heat exchanger 321, and a refrigerant line closing unit 330 installed at a refrigerant line 125*c* between the indoor expansion valve 322 and the heat exchanger 321 for preventing a refrigerant flowing on the refrigerant line 125 of the indoor unit 320 from being introduced into the outdoor unit 310 when power supply to one or more indoor units 320 is cut off.

In the air conditioning system 300 according to the third embodiment of the present invention, the refrigerant line closing unit 330 is installed at the refrigerant line 125*c* between the indoor expansion valve 322 and the heat exchanger 321.

An operation of the air conditioning system 300 according to the third embodiment of the present invention is the same as that of the air conditioning system 100 according to the first embodiment, and thus its detail explanation will be omitted.

Figure 7:
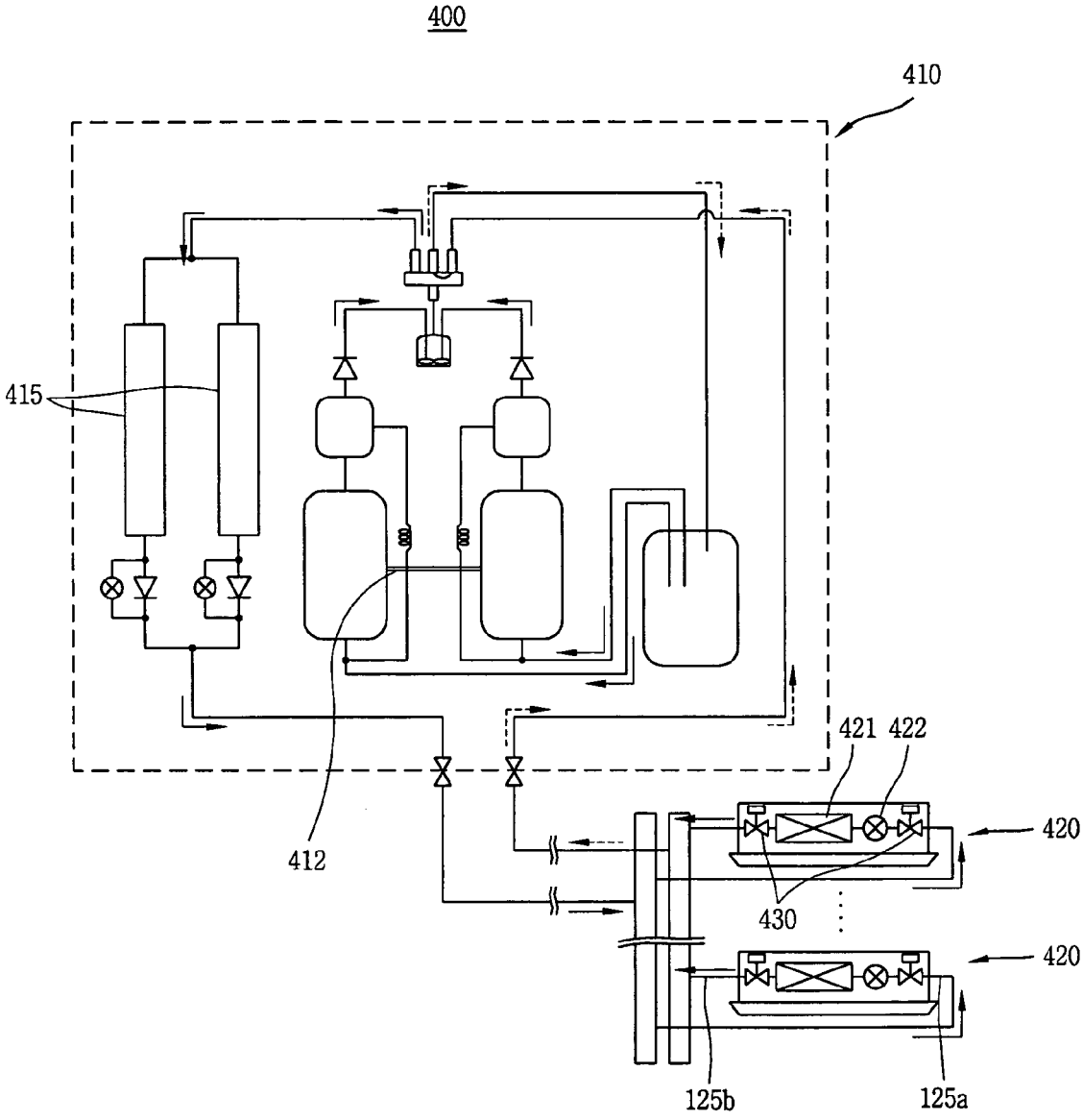
FIG. 7 is a construction view showing an air conditioning system according to a fourth embodiment of the present invention.

FIG. 7 is a construction view showing an air conditioning system according to a fourth embodiment of the present invention.

As shown, the air conditioning system 400 according to the fourth embodiment of the present invention comprises an outdoor unit 410 having a compressor 411 and an outdoor heat exchanger 415, at least one indoor unit 420 having an indoor expansion valve 422 and an indoor heat exchanger 421, and a refrigerant line closing unit 430 installed at an inlet refrigerant line 125*a* and an outlet refrigerant line 125*b* of each of the indoor unit 420 for preventing a refrigerant flowing on the refrigerant line 125 of the indoor unit 420 from being introduced into the outdoor unit 410 when power supply to one or more indoor units 420 is cut off.

In the air conditioning system 400 according to the fourth embodiment of the present invention, the refrigerant line closing unit 430 is installed at both the inlet refrigerant line 125*a* and the outlet refrigerant line 125*b* of the indoor unit 420.

An operation of the air conditioning system 400 according to the fourth embodiment of the present invention is the same as that of the air conditioning system 100 according to the first embodiment, and thus its detail explanation will be omitted.

As aforementioned, a phenomenon that an abnormal refrigerant which has not obtained a sufficient degree of superheat via the indoor expansion valve 122 and the indoor heat exchanger 121 is directly introduced into the outdoor unit 110 when power supply to the indoor unit 120 is cut off due to a static electricity or a short circuit during a cooling operation is prevented by installing the refrigerant line closing unit at the refrigerant line of the indoor unit. Accordingly, the compressor and the entire air conditioning system are prevented from being damaged.

The refrigerant line closing unit can be installed at the inlet refrigerant line of the indoor unit or at the outlet refrigerant line of the indoor unit. Also, the refrigerant line closing unit can be installed between the indoor expansion valve and the indoor heat exchanger, or can be installed at both the inlet refrigerant line and the outlet refrigerant line. Accordingly, the entire air conditioning system can be effectively prevented from being damaged.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An air conditioning system, comprising:

an outdoor unit having a compressor and an outdoor heat exchanger;

at least one indoor unit having an indoor expansion valve and an indoor heat exchanger; and a refrigerant line closing unit installed at a refrigerant line of the indoor unit configured to prevent a refrigerant flowing in the refrigerant line of the indoor unit from being introduced into the outdoor unit when power supply to one or more indoor units is cut off, wherein the refrigerant line closing unit comprises:

a housing installed at the refrigerant line of the indoor unit;

a bobbin installed in the housing and having a coil wound on an outer circumferential surface thereof;

a rod member movably installed at a center of the bobbin and having a valve at one side thereof for opening the refrigerant line of the indoor unit by a magnetization of the coil of the bobbin during a cooling operation; and an elastic member having the rod member inserted therein, wherein the elastic member is a spring, and wherein the valve of the rod member opens the refrigerant line of the indoor unit while power is supplied to the indoor unit, and closes the refrigerant line of the indoor unit by an elastic force of the spring, the spring compressed by the rod member, when power supply to the indoor unit is cut off.

2. The system of claim 1, wherein the refrigerant line closing unit is disposed at an outlet refrigerant line of each of the indoor unit.

3. The system of claim 1, wherein a space in which the rod member moves is formed at a center of the bobbin.

4. The system of claim 1, wherein a motion distance of the valve of the rod member is limited by a stopper installed in the housing.

5. The system of claim 1, wherein a mounting groove for mounting an end surface of the valve of the rod member when the refrigerant line of the indoor unit is closed is formed at a bottom surface of the refrigerant line of the indoor unit.

6. The system of claim 1, wherein the refrigerant line closing unit is installed at an outlet refrigerant line of each of the indoor unit.

7. The system of claim 1, wherein the refrigerant line closing unit is installed between the indoor expansion valve and the indoor heat exchanger.

8. An air conditioning system, comprising:

an outdoor unit having a compressor, an outdoor heat exchanger, and a four-way valve installed at an outlet refrigerant line of the compressor for switching a refrigerant flow;

a plurality of indoor units connected to the outdoor unit by each refrigerant line; and a refrigerant line closing unit installed at the refrigerant line of the indoor unit configured to prevent a refrigerant flowing in the refrigerant line of the indoor unit from being introduced into the outdoor unit when power supply to one or more indoor units is cut off, wherein the refrigerant line closing unit comprises:

a housing installed at the refrigerant line of the indoor unit;

a bobbin installed in the housing and having a coil wound on an outer circumferential surface thereof;

a rod member movably installed at a center of the bobbin and having a valve at one side thereof for opening the refrigerant line of the indoor unit by a magnetization of the coil of the bobbin during a cooling operation; and an elastic member inserted into the rod member, wherein the elastic member is a spring, and wherein the valve of the rod member opens the refrigerant line of the indoor unit while power is supplied to the indoor unit, and closes the refrigerant line of the indoor unit by an elastic force of the spring, the spring compressed by the rod member, when power supply to the indoor unit is cut off.

9. The system of claim 8, wherein the refrigerant line closing unit is installed at both an inlet refrigerant line and an outlet refrigerant line of each of the indoor unit.

10. The system of claim 8, wherein a space where the rod member is moved is formed at a center of the bobbin.

11. The system of claim 8, wherein a motion distance of the valve of the rod member is limited by a stopper installed in the housing.

12. The system of claim 8, wherein a mounting groove for mounting an end surface of the valve of the rod member when the refrigerant line of the indoor unit is closed is formed at a bottom surface of the refrigerant line of the indoor unit.

* * * * *